US005701630A

United States Patent [19]

Liao

[11] Patent Number: 5,701,630

[45] Date of Patent: Dec. 30, 1997

[54] MOP WITH A TAPE OF RAGS TAKING UP MECHANISM

[76] Inventor: Jih-Shun Liao, P.O. Box 82-144, Taipei, Taiwan

[21] Appl. No.: 636,355

[22] Filed: Apr. 23, 1996

[51] Int. Cl.[6] ..... A47L 13/20

[52] U.S. Cl. ..... 15/228; 15/231

[58] Field of Search ..... 15/99, 228, 231

[56] References Cited

U.S. PATENT DOCUMENTS

| | | | |
|---|---|---|---|
| 899,725 | 9/1908 | Goodier | 15/228 |
| 899,726 | 9/1908 | Goodier | 15/228 |
| 1,130,064 | 3/1915 | Buchanan | 15/228 |
| 2,690,582 | 10/1954 | Sundell | 15/228 |
| 3,116,504 | 1/1964 | Unterbrink et al. | 15/231 |
| 3,132,369 | 5/1964 | McMaster et al. | 15/228 X |
| 3,916,470 | 11/1975 | May | 15/99 X |
| 4,121,315 | 10/1978 | Buser | 15/228 |
| 4,510,642 | 4/1985 | Ingermann et al. | 15/228 X |
| 5,092,699 | 3/1992 | Silvenis | 15/228 X |
| 5,542,143 | 8/1996 | Jem-Yuan | 15/228 X |

*Primary Examiner*—Mark Spisich
*Attorney, Agent, or Firm*—Alfred Lei

[57] ABSTRACT

A mop including a telescopic sleeve, a handle grip coupled to one end of the telescopic sleeve, a mophead holder coupled to one end of the telescopic sleeve remote from the handle grip, a retractable handle mounted in the telescopic sleeve and having a top end inserted into a hole in the handle grip and a bottom end inserted into a hole in the mophead holder, a lever pivoted to the handle grip and coupled to the top end of the retractable handle, a mophead turned about a pivot on the mophead holder a ratchet transmission mechanism mounted in the mophead holder and coupled to the bottom end of the retractable handle by a steel cable and driven by the lever through the retractable handle and the steel cable to turn the mophead, a tape of rags having a fixed end fixedly secured to the mophead holder and a free end detachably connected to the mophead by a tape of loop and hook materials, the mophead holder being turned by the ratchet transmission mechanism to take up the tape of rags when the lever is pulled.

3 Claims, 12 Drawing Sheets

MOP WITH A TAPE OF RAGS TAKING UP MECHANISM

BACKGROUND OF THE INVENTION

1. Field of the Invention

This invention relates to mops, and relates more particularly to such a mop which comprises a tape of rags, and a mop head driven by a lever through a ratchet transmission mechanism to take up the tape of rags for cleaning floors.

2. Description of the Prior Art

Conventional mops are commonly comprised of a bundle of coarse yarn, rags, etc., fixed on the end of a long stick. Because the bundle of coarse yarn, rags, etc., is not replaceable, the service life of these mops is short. FIG. 1 shows another structure of mop which has a telescopic handle, and a mophead holder fixed on the end of the telescopic handle to hold a sponge. Because the face of the sponge is not changeable, the sponge will be contaminated with dirt quickly. Therefore, the sponge washed when cleaning the floor. FIGS. 2A and 2B show a mop according to Taiwanese Pat. Publication No. 223,256. This structure of mop comprises a mophead (2) transversely mounted in the front fork (11) of the handle (1). The front fork (11) of the handle (1) has two bevel gears (112) at two opposite locations. The mophead (2) is detachably coupled with tape of rags, having two bevel gears (222) at two opposite ends respectively meshed with the bevel gears (112). The bevel gears (112, 222) are allowed to be turned in one direction only. When the mophead (2) is moved over the floor, it is rotated to take up the tape of rags. However, this structure of mop still has numerous drawbacks. One drawback of this structure of mop is that when the mophead (2) is moved over the floor, it is continuously rotated to continuously take up the tape of rags, therefore the tape of rags is quickly contaminated with dirt when the mophead is moved over a certain distance. Another drawback of this structure of mop is its complicated procedure to release the tape of rags from the mophead. Because the mophead is prohibited from reverse rotation, the tape of rags can be released from the mophead only when it is moved around the mophead in the reversed direction. Still another drawback of this structure of mop is that the tape of rags must be frequently washed because it will be contaminated with dirt quickly when the mop is operated. Still another drawback of this structure of mop is that the tape of rags tends to deviate from course when it is taken up by the mophead. Furthermore, because the mophead is mounted in the front fork (11) of the handle (1), it is not suitable for cleaning corner areas.

SUMMARY OF THE INVENTION

This invention relates to a mop which comprises a tape of rags, and a mop head driven by a lever through a ratchet transmission mechanism to take up the tape of rags for cleaning floors.

According to one aspect of the present invention, the mop comprises a telescopic sleeve, a handle grip coupled to one end of the telescopic sleeve, a mophead holder coupled to one end of the telescopic sleeve remote from the handle grip, a retractable handle mounted in the telescopic sleeve and having a top end inserted into a hole in the handle grip and a bottom end inserted into a hole in the mophead holder, a lever pivoted to the handle grip and coupled to the top end of the retractable handle, a mophead turned about a pivot on-the mophead holder a ratchet transmission mechanism mounted in the mophead holder and coupled to the bottom end of the retractable handle by a steel cable and driven by the lever through the retractable handle and the steel cable to turn the mophead, a tape of rags having a fixed end fixedly secured to the mophead holder and a free end detachably connected to the mophead by a tape of loop and hook materials, the mophead holder being turned by the ratchet transmission mechanism to take up the tape of rags when the lever is pulled, wherein the ratchet wheel transmission mechanism is comprised of a pull arm, a holder frame, a double-end pawl, a ratchet wheel, a first tensile spring, and a second tensile spring, the double-end pawl being turned about a pivot in the mophead holder and having one end supported on the second tensile spring inside the holder frame and an opposite end meshed with the ratchet wheel, the pull arm having a top end inserted through a hole on a transverse rod in one arm of the mophead holder and coupled to the steel cable and a bottom end connected to the holder frame, the first tensile spring being mounted around the pull arm and stopped between the transverse rod and the holder frame. According to another aspect of the present invention, the free end of the tape of rags is fixed to a roll, which is mounted between two arms of the mophead holder. As an alternate form of the present invention, the mophead holder has only one arm, which holds one end of the mophead and the ratchet transmission mechanism on the inside, and the fixed end of the tape of rags is moved over a sloping guide wall at the front side of the mophead holder and then fixed to the sleeve by a clamp.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENTS

Figure 1:
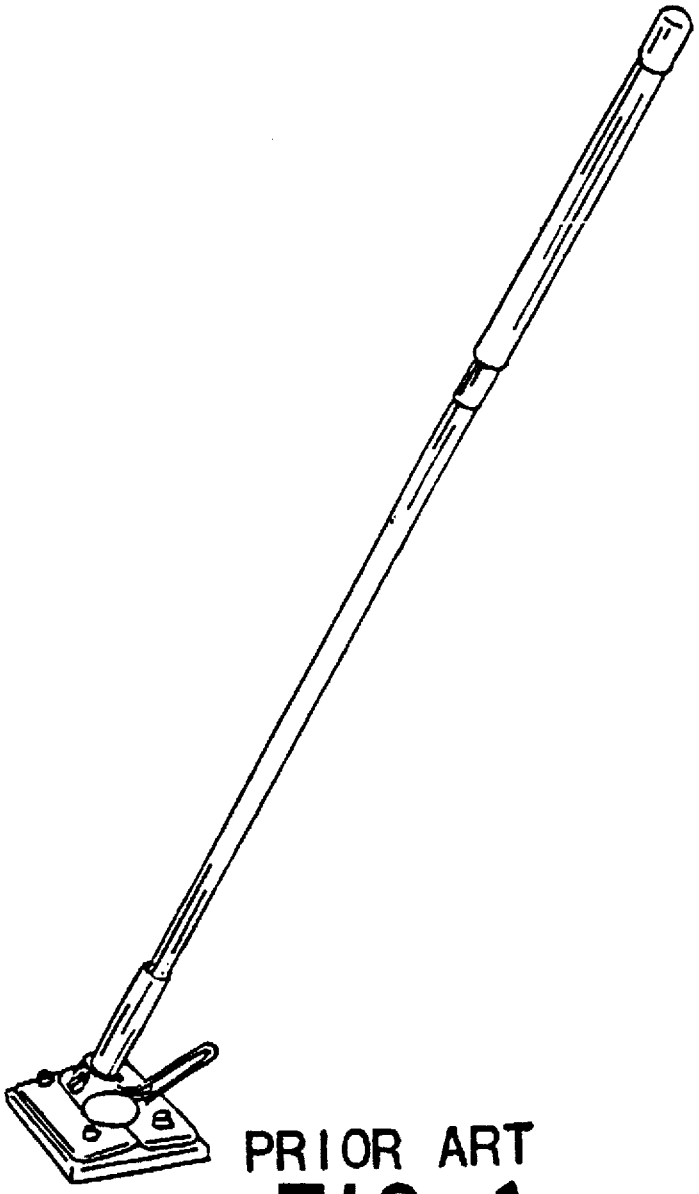
PRIOR ART FIG. 1
FIG. 1 is an elevational view of a mop according to the prior art.
Figure 2A:
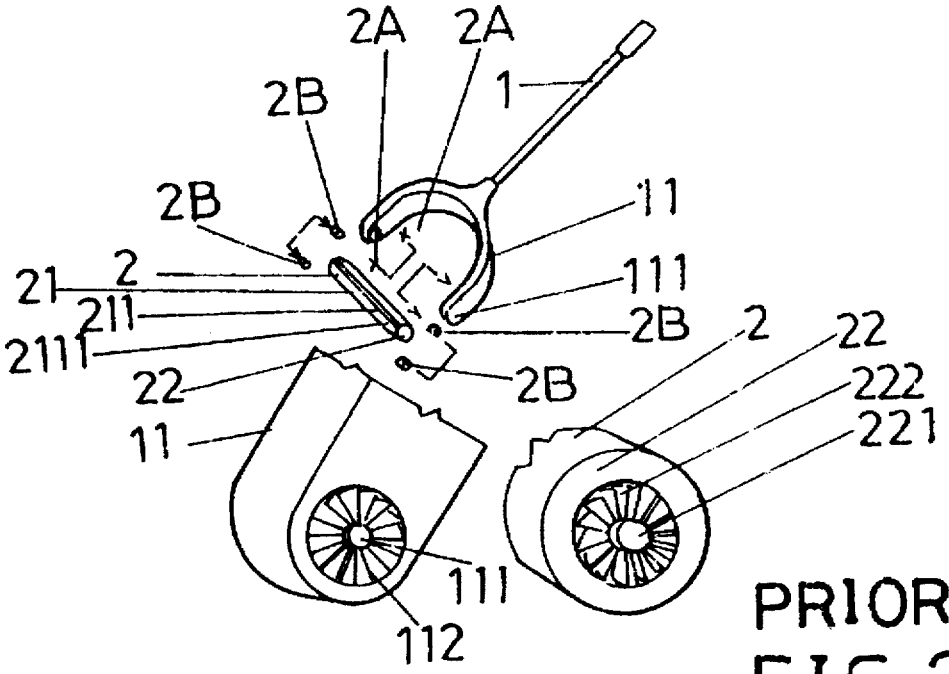
PRIOR ART FIG. 2A
FIG. 2A is exploded view of a mop according to Taiwanese Pat. Publication No. 223,256.
Figure 2B:
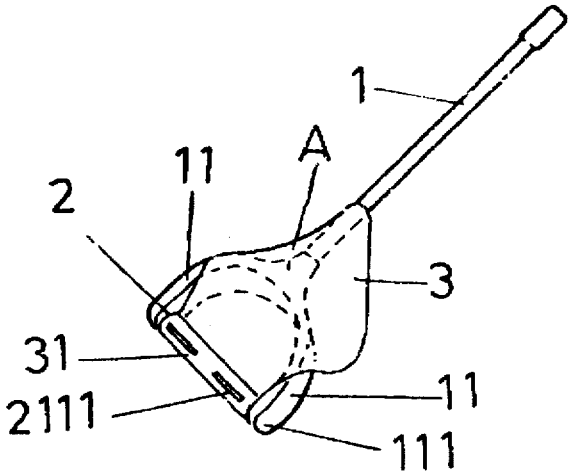
PRIOR ART FIG. 2B
FIG. 2B is a perspective view of the mop shown in FIG. 2A.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
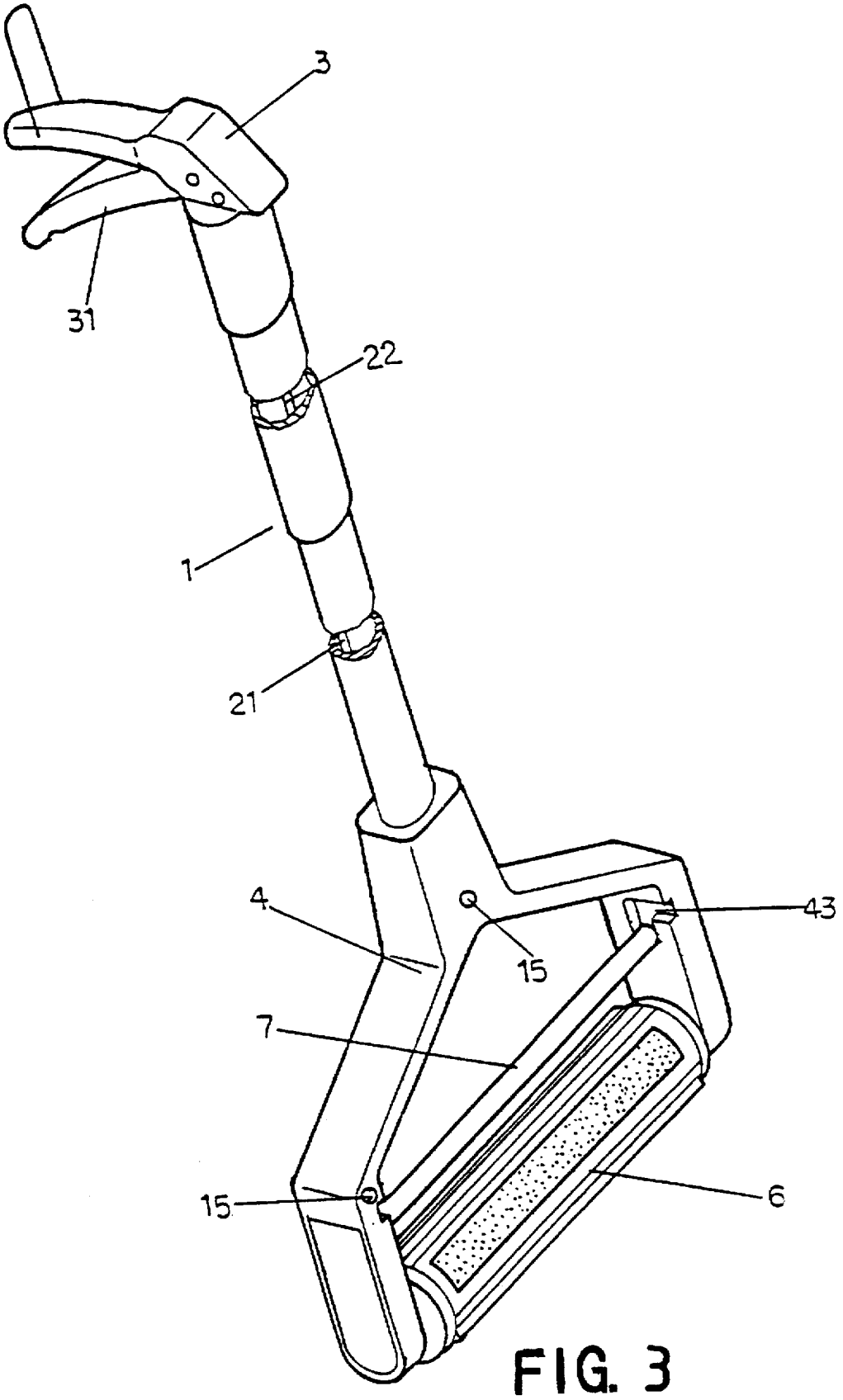
FIG. 3 is an elevational view of a mop according to one embodiment of the present invention.
Figure 4:
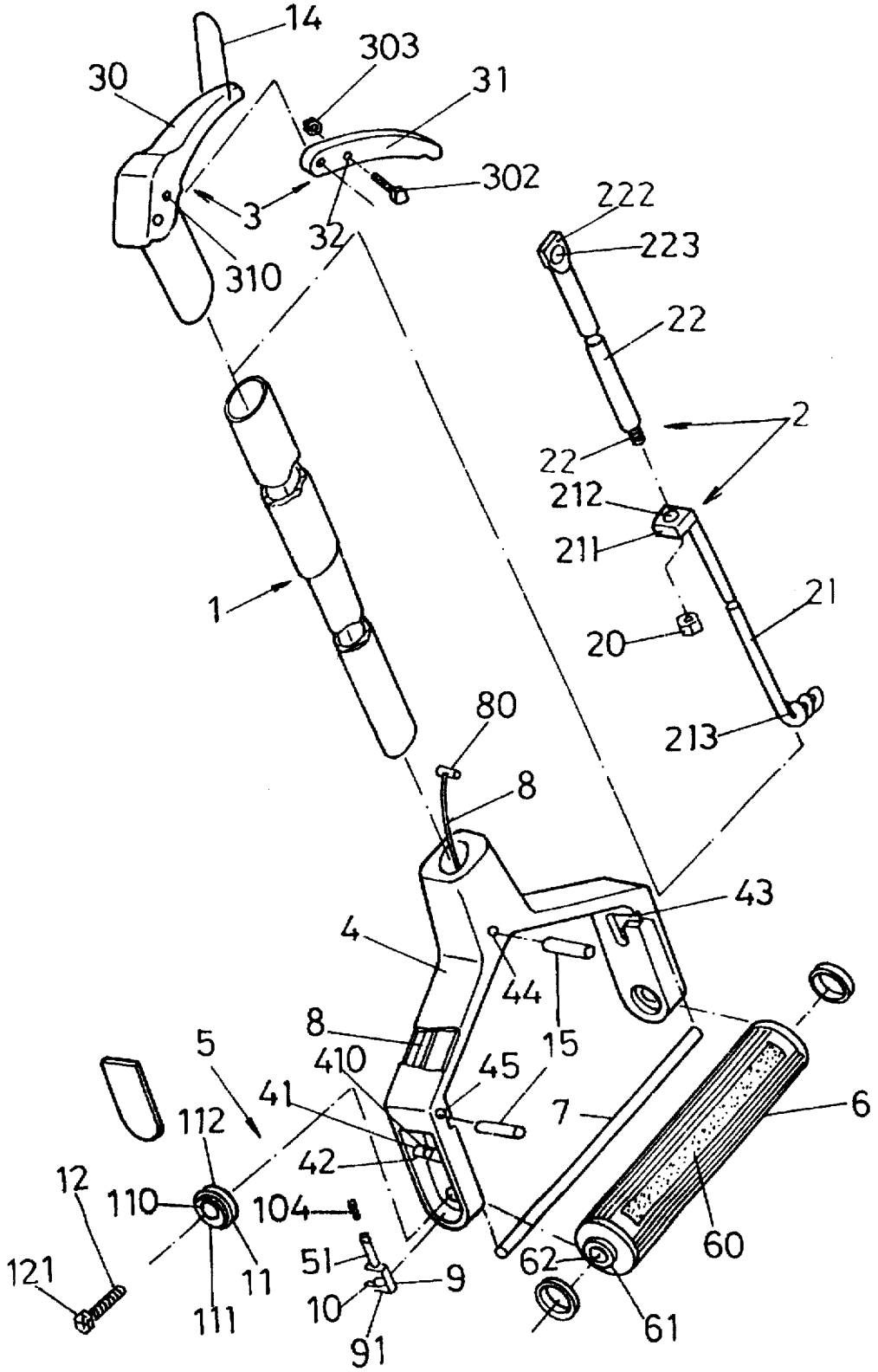
FIG. 4 is an exploded view of the mop shown in FIG. 3.
Figure 5:
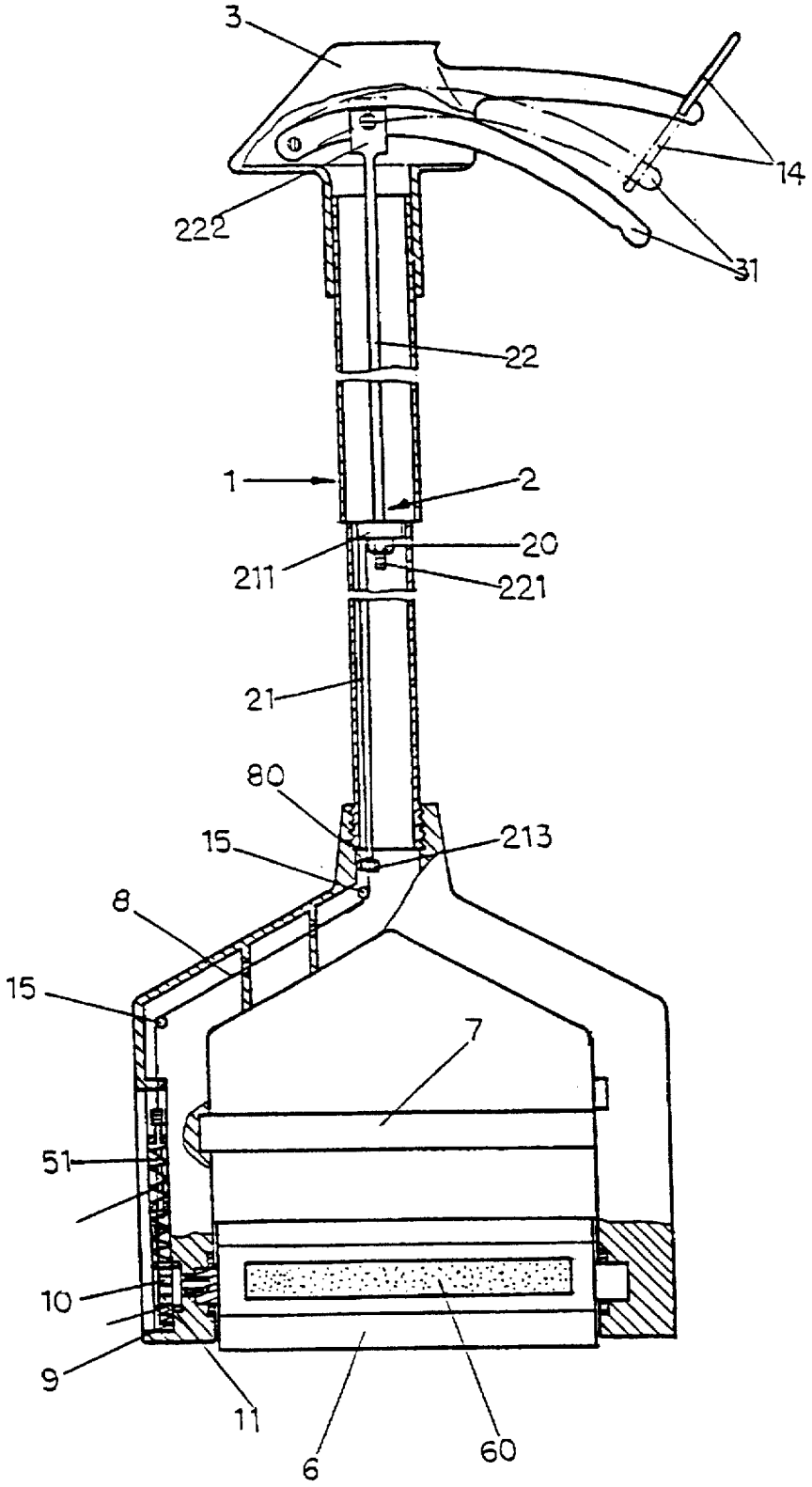
FIG. 5 is a sectional plain view of the mop shown in FIG. 3.

Referring to FIGS. 3, 4, and 5, a mop in accordance with the present invention is generally comprised of a telescopic sleeve 1, a retractable handle 2, a handle grip and control lever assembly 3, a forked mophead holder 4, a ratchet transmission mechanism 5, a mophead 6, and a driven roll 7. The telescopic sleeve 1 is sleeved onto the retractable handle 2. The retractable handle 2 is comprised of a first handle member 21, a second handle member 22, and a cap nut 20. The first handle member 21 is made from a steel rod, having an offset flat head 211 at the top and a spiral tail 213 at the bottom. The offset flat head 211 of the first handle member 21 has a center through hole 212. The second handle member 22 is inserted through the center through hole 212 of the offset flat head 211 of the first handle member 21, having a bottom end terminating in a screw rod 221 screwed up with the cap nut 20, and a top end terminating in a flat coupling portion 222 disposed out of the top end of the telescopic sleeve 1. The flat coupling portion 222 has a through hole 223. The handle grip and control lever assembly 3 comprises a hollow handle grip 30 mounted on the top end of the telescope sleeve 1, and a lever 31 having one end pivoted to the handle grip 30. The lever 31 has a pivot hole 32 in the middle pivotably connected to a pivot hole 310 on the handle grip 30 and the through hole 223 of the flat coupling portion 222 of the second handle member 22 of the retractable handle 2 by a screw 302 and a nut 303. A steel cable 8 is mounted in the forked mophead holder 4, having a head 80 at one end coupled to the spiral tail 213 of the first handle member 21 of the retractable handle 2. The opposite end of the steel cable 8 is connected to the pull arm 51 of the ratchet transmission mechanism 5. The pull arm 51 of the ratchet transmission mechanism 5 is mounted in a hole 410 in a transverse rod 41 in one hollow arm 42 of the forked mophead holder 4. The pull arm 51 has a bottom end mounted with a holder frame 9. A tensile spring 104 is mounted around the pull arm 51 and stopped between the holder frame 9 and the transverse rod 41. The holder frame 9 defines a substantially U-shaped opening 91. A double-end pawl 10 is mounted in the opening 91 of the holder frame 9. A ratchet wheel 11 is mounted in the arm 42 of the forked mophead holder 4 and acts against the pawl 10. The ratchet wheel 11 has a center hole 110 coupled to the round pin 61 of the mophead 6 at one end, a flange 112 at one side, and a hexagonal recess 111 within the flange 112 and in alignment with the center hole 110. A hexagon head bolt 12 is inserted through the hexagonal recess 111 and center hole 110 of the ratchet wheel 11 and threaded into a screw hole 62 at one end of the round pin 61 of the mophead 6 to fix the ratchet wheel 11 to the mophead 8. When the hexagon head bolt 12 is installed, the hexagon head 121 is fitted into the hexagonal recess 111. The opposite end of the round pin 61 of the mophead 6 is revolvably coupled to the opposite arm 43 of the forked mophead holder 4. Transverse guide pins 15 are mounted in respective pin holes 44, 45 in the forked mophead holder 4 to stretch the steel cable 8 and to guide its movement in the forked mophead holder 4. The driven roll 7 is revolvably mounted between the arms 42, 43 of the forked mophead holder 4 and disposed in parallel to the mophead 6.

Figure 6:
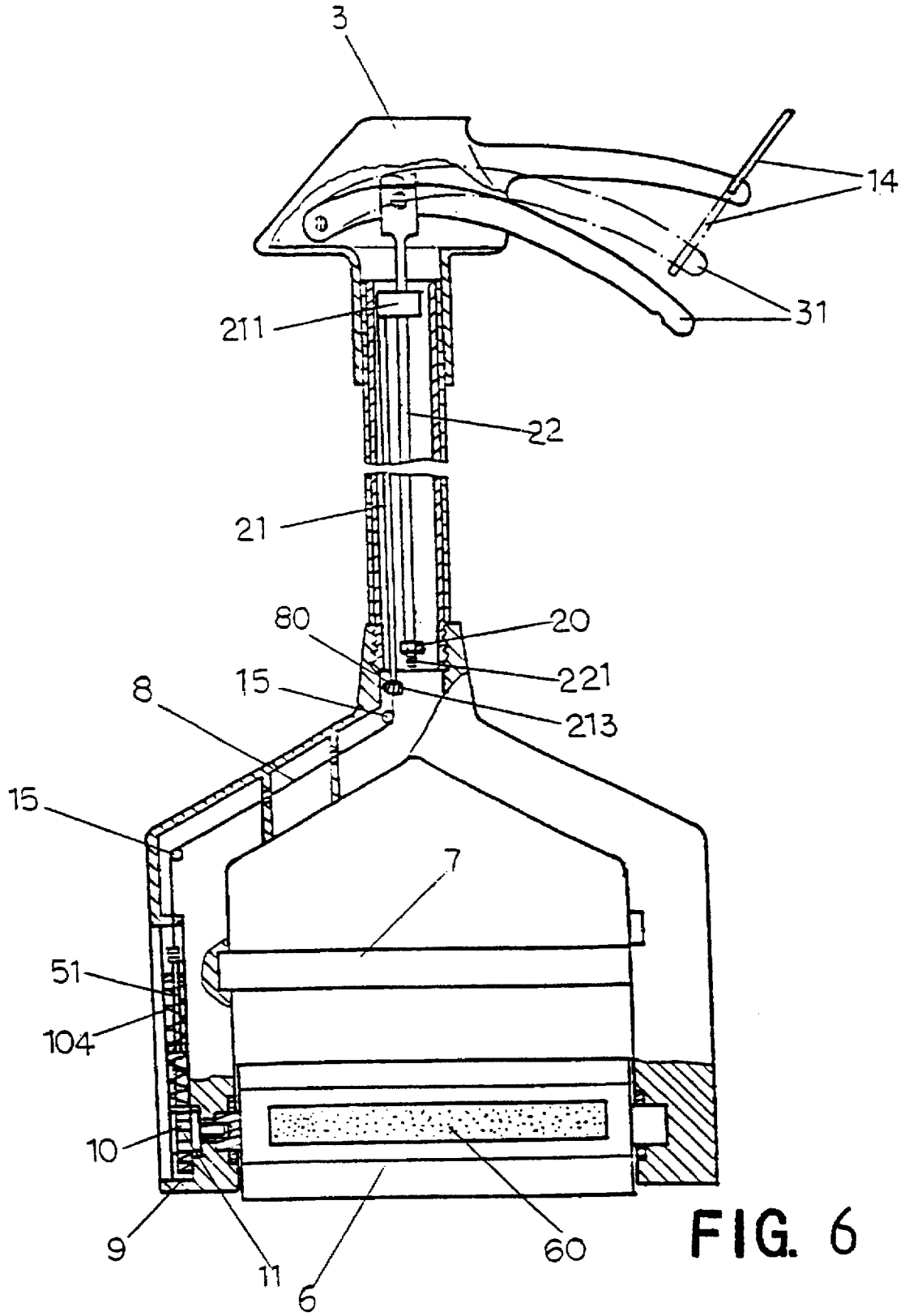
FIG. 6 is similar to FIG. 5 but showing the sleeve and the retractable handle collapsed.
Figure 7:
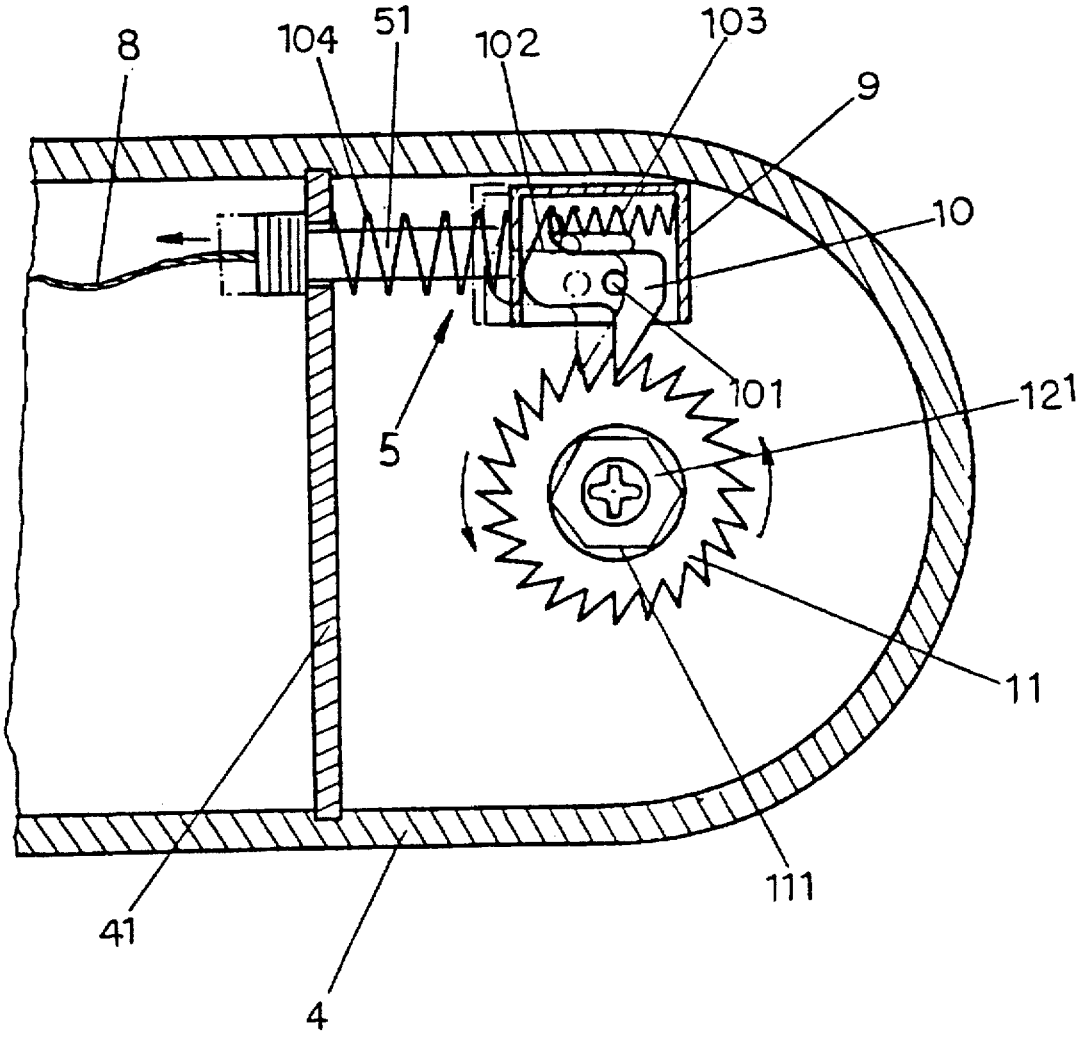
FIG. 7 is a sectional view in an enlarged scale of the ratchet wheel transmission mechanism according to the present invention.
Figure 8:
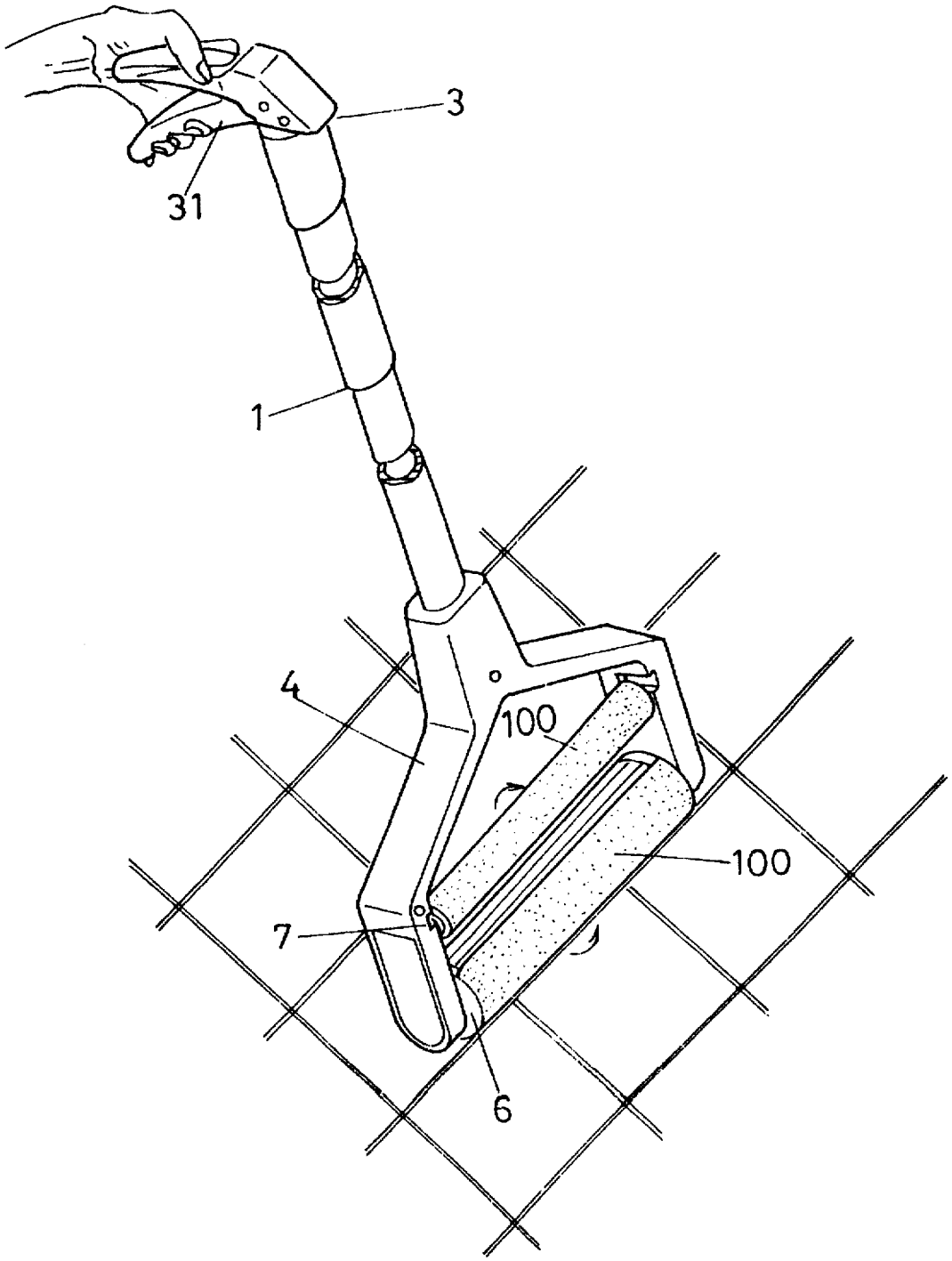
FIG. 8 is an applied view of the mop shown in FIG. 3, showing the tape of rags taken up by the mophead from the driven roll.
Figure 9:
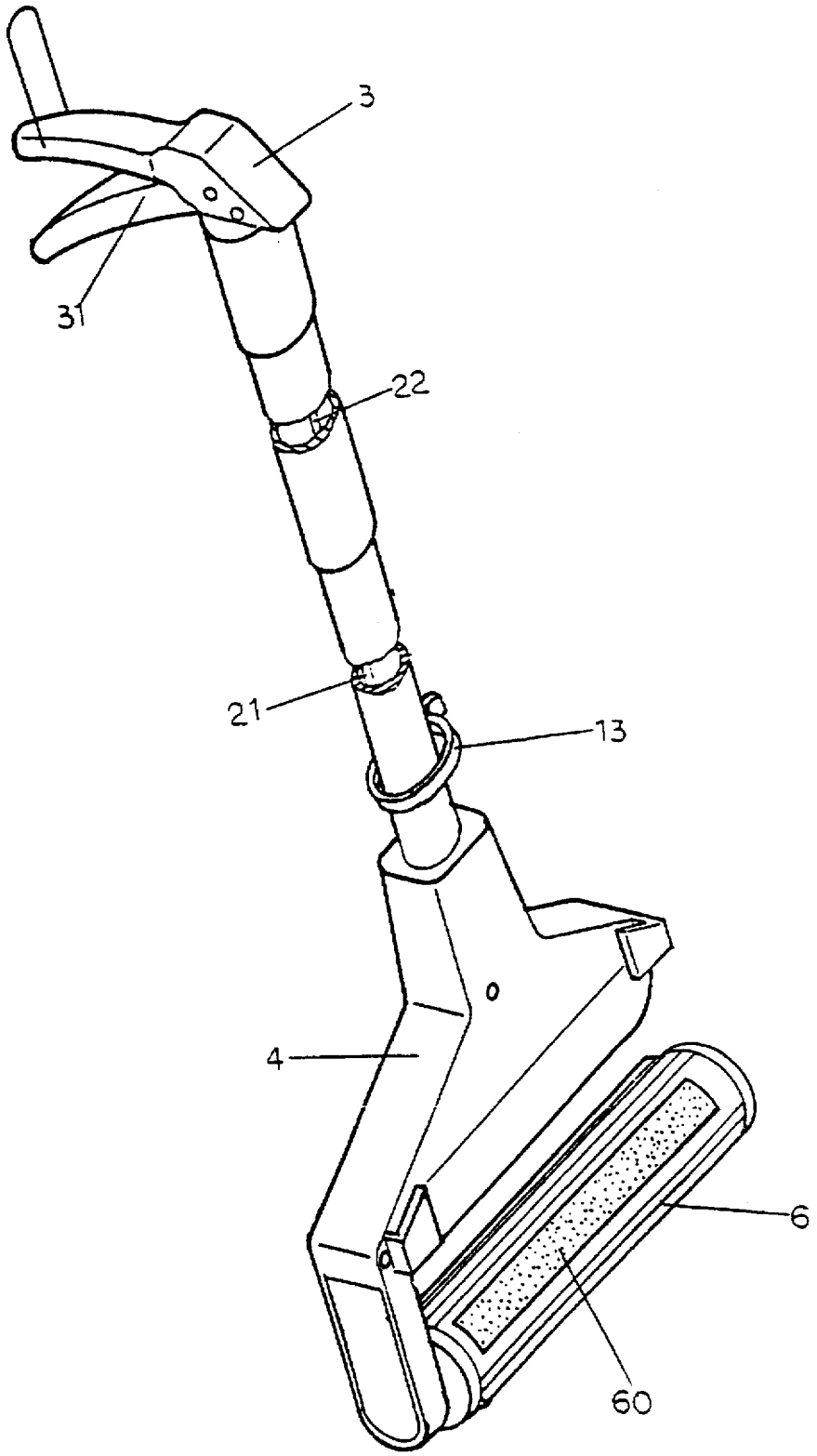
FIG. 9 is an elevational view of an alternate form of the present invention.
Figure 10:
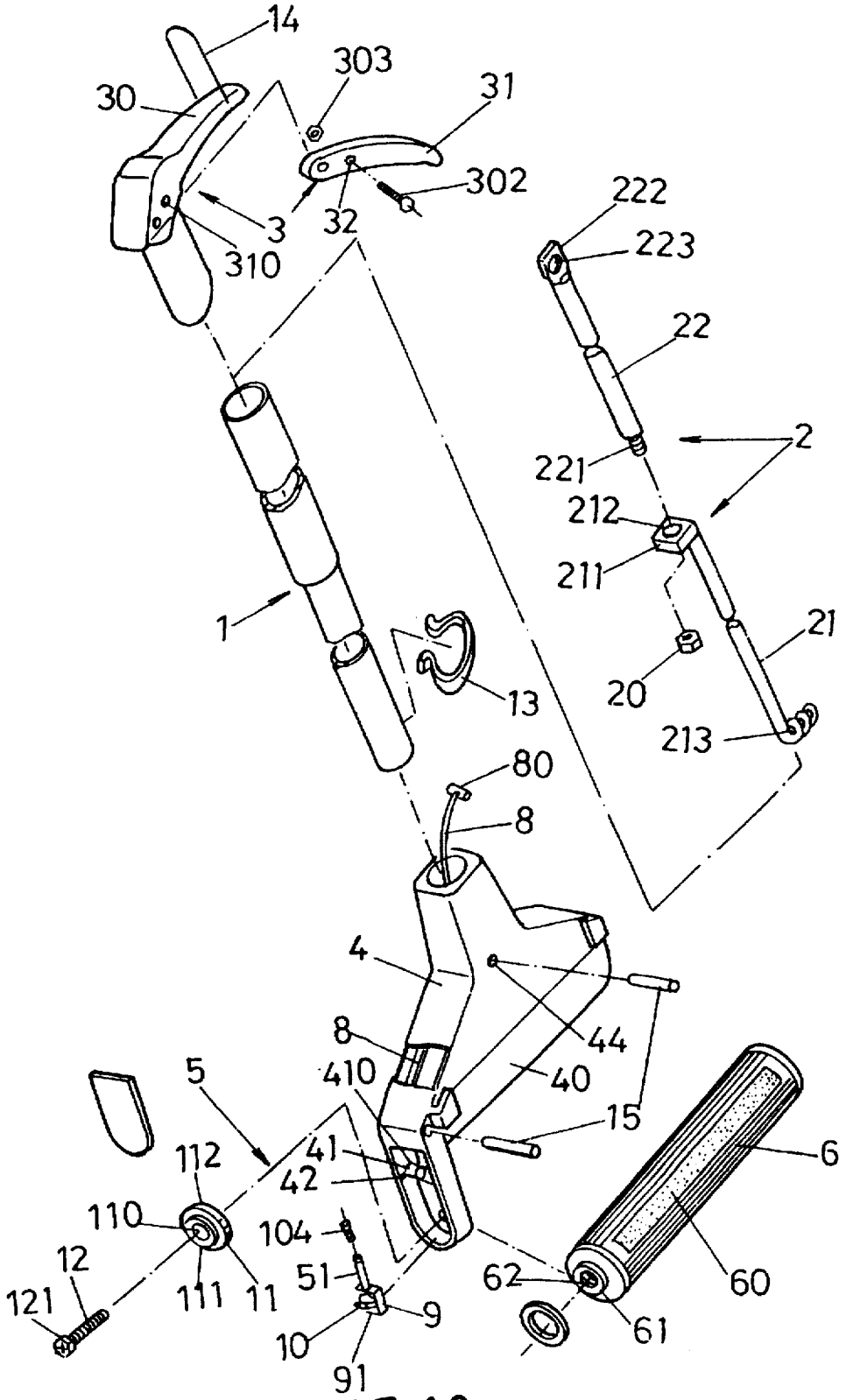
FIG. 10 is an exploded view of the mop shown in FIG. 9.
Figure 11:
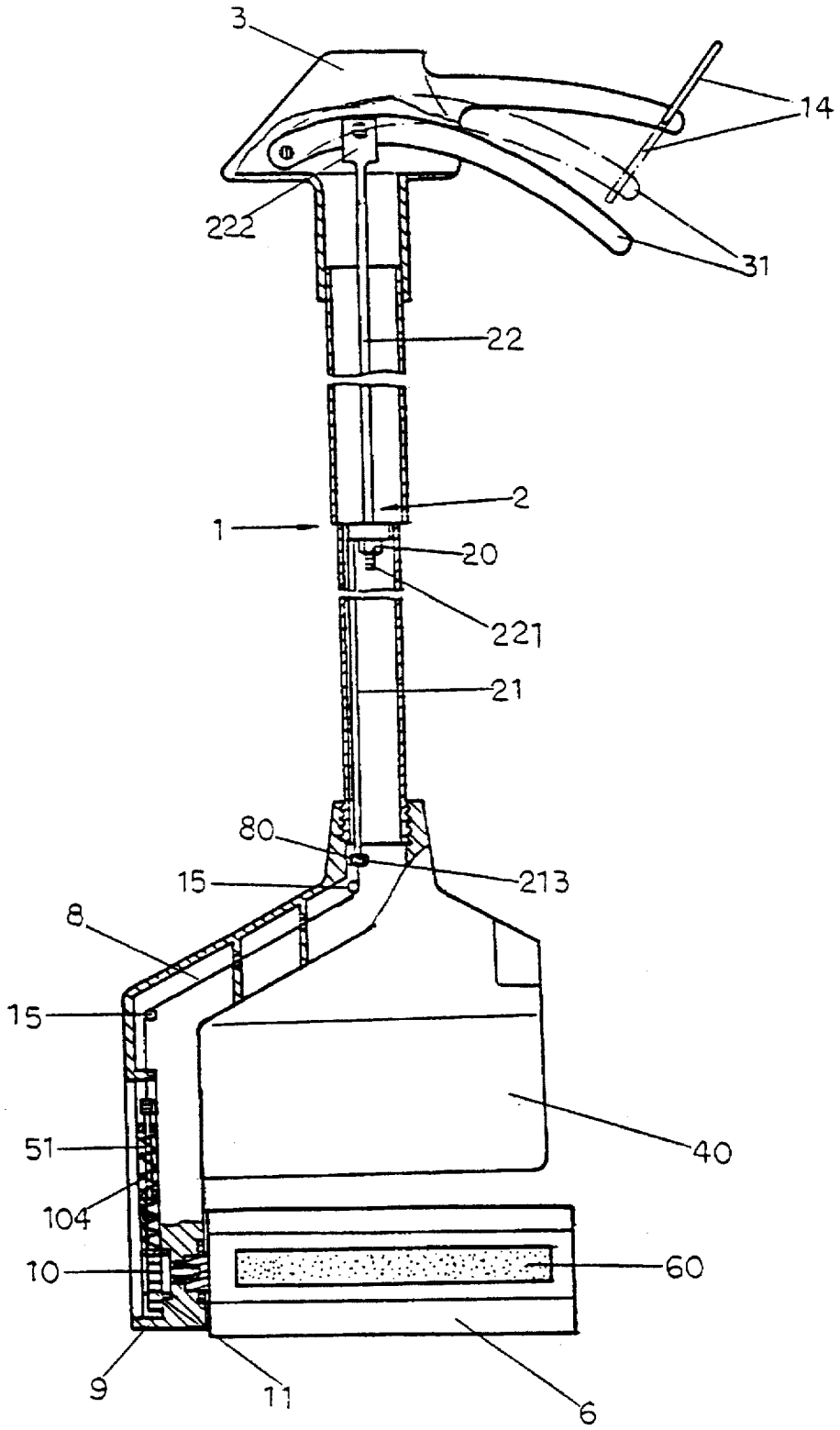
FIG. 11 is a sectional plain view of the mop shown in FIG. 9.

Referring to FIGS. 6, 7, and 8, a tape of rags 100 is coupled between the mophead 6 and the driven roll 7. The tape of rags 100 has one end fixedly secured to and wound round the driven roll 7, and an opposite end secured to the mophead 6 by a tape of loop and hook materials 60. When the lever 31 is pulled upwards, the retractable handle 2 is driven to pull the steel cable 8, causing the it to pull the pull arm 51 of the ratchet transmission mechanism 5. When the pull arm 51 of the ratchet transmission mechanism 5 is pulled, the pawl 10 is driven to turn the ratchet wheel 11, causing the mophead 6 to take up the tape of rags 100 from the driven roll 7. Therefore, the tape of rags 100 is taken up step by step when moved to clean the floor.

Referring to FIG. 6 again, when the telescopic sleeve 1 is collapsed, the retractable handle 2 is also collapsed, and the size of the mop is diminished. When the tape of rags 100 is completely taken up by the mophead 6, the pawl 10 is released from the ratchet wheel 11. When the pawl 10 is released from the ratchet wheel 11, the lever 31 is locked by a retainer loop 14 on the handle grip 30, and therefore the tape of rags 100 can be pulled out of the mophead 6 for washing. After cleaning, the tape of rags 100 is secured to the mophead 6 again for further cleaning purpose.

Figures from 9 to 12 show an alternate form of the present invention. According to this alternate form, the mophead holder 4 has only one arm 42; the structure of the ratchet transmission mechanism 5 remains unchanged; the aforesaid driven roll 7 is eliminated. As illustrated, the mophead holder 4 has a sloping guide wall 40. The tape of rags 100 has one end fastened to the telescopic sleeve 1 by a clamp 13, and an opposite end passing over the sloping guide wall 40 and then fastened to the mophead 6 by the tape of loop and hook materials 60. When the lever 31 is continuously pulled up, the ratchet wheel 11 is turned to rotate the mophead 6, causing it to take up the tape of rags 100. This design of single arm mophead holder is suitable for cleaning corner areas.

Figure 12:
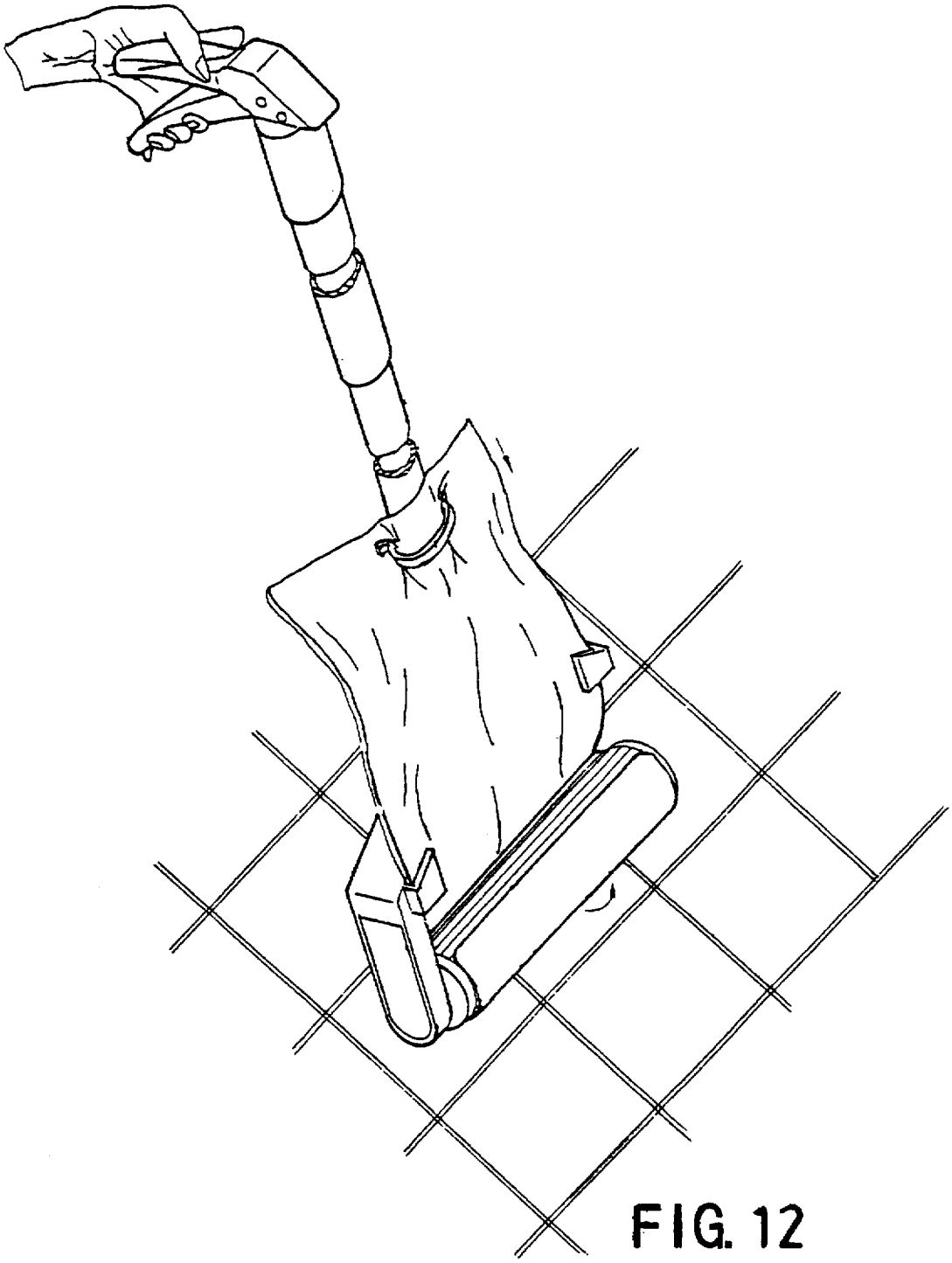
FIG. 12 is an applied view of the mop of FIG. 9.

Referring to FIG. 7 again, the ratchet transmission mechanism 5 is comprised of a pull arm 51, a holder frame 9, a double-end pawl 10, and a ratchet wheel 11. The double-end pawl 10 is turned about a pivot 101 in the holder frame 9, having one end supported on a tensile spring 103, and an opposite end meshed with the ratchet wheel 11. The pull arm 51 has one end coupled to the steel cable 8. The aforesaid tensile spring 104 is mounted around the pull arm 51 and stopped between the transverse rod 41 and the holder frame 9. Please refer to FIGS. 8 and 12 again, when the pull cable 8 is pulled upwards to lift the pull arm 51 once, the pawl 10 is forced to turn the ratchet wheel 11 and the mophead 6, causing the mophead 6 to take up the tape of rags 100 for one step. Therefore, continuously pull and release the lever 31, the mophead 6 is continuously rotated to take up the tape of rags 100 step by step.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A mop comprising a telescopic sleeve, a handle grip coupled to one end of said telescopic sleeve, a mophead holder coupled to one end of said telescopic sleeve remote from said handle grip, a retractable handle mounted in said telescopic sleeve and having a top end inserted into a hole in said handle grip and a bottom end inserted into a hole in said mophead holder, a lever pivoted to said handle grip and coupled to the top end of said retractable handle, a mophead turned about a pivot on said mophead holder, a ratchet transmission mechanism mounted in said mophead holder and coupled to the bottom end of said retractable handle by a steel cable and driven by said lever through said retractable handle and said steel cable to turn said mophead, a tape of rags having a fixed end fixedly secured to said mophead holder and a free end detachably connected to said mophead by a tape of loop and hook materials, said mophead being turned by said ratchet transmission mechanism to take up said tape of rags when said lever is pulled, said ratchet transmission mechanism comprised of a pull arm, a holder frame, a double-end pawl, a ratchet wheel, a first tensile spring, and a second tensile spring, said double-end pawl being turned about a pivot in said mophead holder and having one end supported on said second tensile spring inside a holder frame and an opposite end meshed with said ratchet wheel, said pull arm having a top end inserted through a hole on a transverse rod in one arm of said mophead holder and coupled to said steel cable and a bottom end connected to said holder frame, said first tensile spring being mounted around said pull arm and stopped between said transverse rod and said holder frame.

2. The mop as claimed in claim 1 wherein the free end of said tape of rags is fixed to a roll, which is mounted between two arms of said mophead holder.

3. The mop as claimed in claim 1 wherein said mophead holder has one arm, which holds one end of said mophead and said ratchet transmission mechanism on the inside, and a sloping guide wall at a front side thereof adapted to guide the movement of said tape of rags; said telescopic sleeve is mounted with a clamp, which holds the fixed end of said tape of rags.

* * * * *